US010738408B2

(12) United States Patent
Lee et al.

(10) Patent No.: US 10,738,408 B2
(45) Date of Patent: Aug. 11, 2020

(54) CLOTHES TREATING APPARATUS

(71) Applicant: LG Electronics Inc., Seoul (KR)

(72) Inventors: Byungjin Lee, Seoul (KR); Yanghwan No, Seoul (KR); Inhee Han, Seoul (KR); Jihong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/067,978

(22) PCT Filed: Jan. 2, 2017

(86) PCT No.: PCT/KR2017/000021

§ 371 (c)(1),
(2) Date: Jul. 3, 2018

(87) PCT Pub. No.: WO2017/119686

PCT Pub. Date: Jul. 13, 2017

(65) Prior Publication Data

US 2019/0024296 A1 Jan. 24, 2019

(30) Foreign Application Priority Data

Jan. 4, 2016 (KR) ..... 10-2016-0000556

(51) Int. Cl.
*D06F 39/04* (2006.01)
*D06F 21/08* (2006.01)
(Continued)

(52) U.S. Cl.
CPC ..... *D06F 39/04* (2013.01); *D06F 21/08* (2013.01); *D06F 37/12* (2013.01); *D06F 37/267* (2013.01);
(Continued)

(58) Field of Classification Search
CPC ..... D06F 21/08; D06F 37/267; D06F 37/30; D06F 39/12; D06F 37/40; D06F 39/08;
(Continued)

(56) References Cited

U.S. PATENT DOCUMENTS 6,105,403 A * 8/2000 Carow, Jr. ..... D06F 37/28 220/849
8,490,438 B2 * 7/2013 Kim ..... D06F 25/00 34/596
(Continued)

FOREIGN PATENT DOCUMENTS

CN 1610776 4/2005
CN 1977077 6/2007
(Continued)

OTHER PUBLICATIONS

Australian Office Action in Australian Application No. 2017205807, dated Sep. 21, 2018, 3 pages.
(Continued)

*Primary Examiner* — Benjamin L Osterhout
(74) *Attorney, Agent, or Firm* — Fish & Richardson P.C.

(57) ABSTRACT

The present invention relates to a clothes treating apparatus comprising: a housing; a tub which is provided in the housing and stores water; a drum which is provided in the tub and stores laundry; a driving unit which is provided on the external bottom surface of the tub and rotates the drum; a heater which heats the water stored in the tub; and a receiving part which is downwardly recessed from the bottom surface of the tub so that the heater is received therein, and which has one portion thereof protruding from the outer circumference to the radial direction of the bottom surface of the tub.

22 Claims, 8 Drawing Sheets

(51) Int. Cl.

| | |
|---|---|
| ***D06F 37/12*** | (2006.01) |
| ***D06F 37/30*** | (2020.01) |
| ***D06F 39/12*** | (2006.01) |
| ***D06F 37/26*** | (2006.01) |
| *D06F 39/08* | (2006.01) |
| *D06F 37/24* | (2006.01) |
| *D06F 29/00* | (2006.01) |

(52) U.S. Cl.
CPC ..... *D06F 37/30* (2013.01); *D06F 39/12* (2013.01); *D06F 29/00* (2013.01); *D06F 37/24* (2013.01); *D06F 37/261* (2013.01); *D06F 37/263* (2013.01); *D06F 39/08* (2013.01); *D06F 2204/086* (2013.01); *D06F 2216/00* (2013.01)

(58) Field of Classification Search
CPC ..... D06F 37/12; D06F 37/24; D06F 39/04; D06F 2216/00; D06F 2204/086
See application file for complete search history.

(56) References Cited

U.S. PATENT DOCUMENTS

| | | | | |
|---|---|---|---|---|
| 9,745,682 | B2 * | 8/2017 | Park | D06F 58/10 |
| 9,840,799 | B2 * | 12/2017 | Sang | D06F 29/005 |
| 2004/0083770 | A1 | 5/2004 | Lyu | |
| 2008/0209954 | A1 | 9/2008 | Nakiri | |
| 2009/0113945 | A1 * | 5/2009 | Kim | D06F 17/04 68/5 C |
| 2009/0133198 | A1 * | 5/2009 | Lee | D06F 29/00 8/158 |
| 2009/0288452 | A1 * | 11/2009 | Lee | D06F 39/022 68/12.18 |
| 2010/0011609 | A1 * | 1/2010 | Park | D06F 58/10 34/88 |
| 2010/0101282 | A1 * | 4/2010 | Jeong | D06F 31/00 68/139 |
| 2011/0265524 | A1 * | 11/2011 | Kim | D06F 29/00 68/13 R |
| 2013/0047677 | A1 * | 2/2013 | Han | D06F 39/02 68/27 |
| 2014/0053612 | A1 * | 2/2014 | Son | D06F 29/00 68/28 |
| 2014/0196507 | A1 * | 7/2014 | Lee | D06F 29/00 68/27 |
| 2015/0059418 | A1 * | 3/2015 | Lee | D06F 37/267 68/17 R |
| 2015/0345063 | A1 * | 12/2015 | Sang | D06F 29/005 68/20 |

FOREIGN PATENT DOCUMENTS

| | | |
|---|---|---|
| CN | 204690390 | 10/2015 |
| CN | 105155227 | 12/2015 |
| JP | 2015205109 | 11/2015 |
| KR | 100199456 | 6/1999 |
| KR | 1020030040116 | 5/2003 |
| KR | 1020100129149 | 12/2010 |
| KR | 1020110121091 | 11/2011 |

OTHER PUBLICATIONS

Chinese Office Action in Chinese Application No. 201780005763.7, dated Dec. 27, 2019, 19 pages (with English translation).
Extended European Search Report in EP Patent Application No. 17736059.1, dated Oct. 17, 2019, 8 pages.

* cited by examiner

【FIG 1】
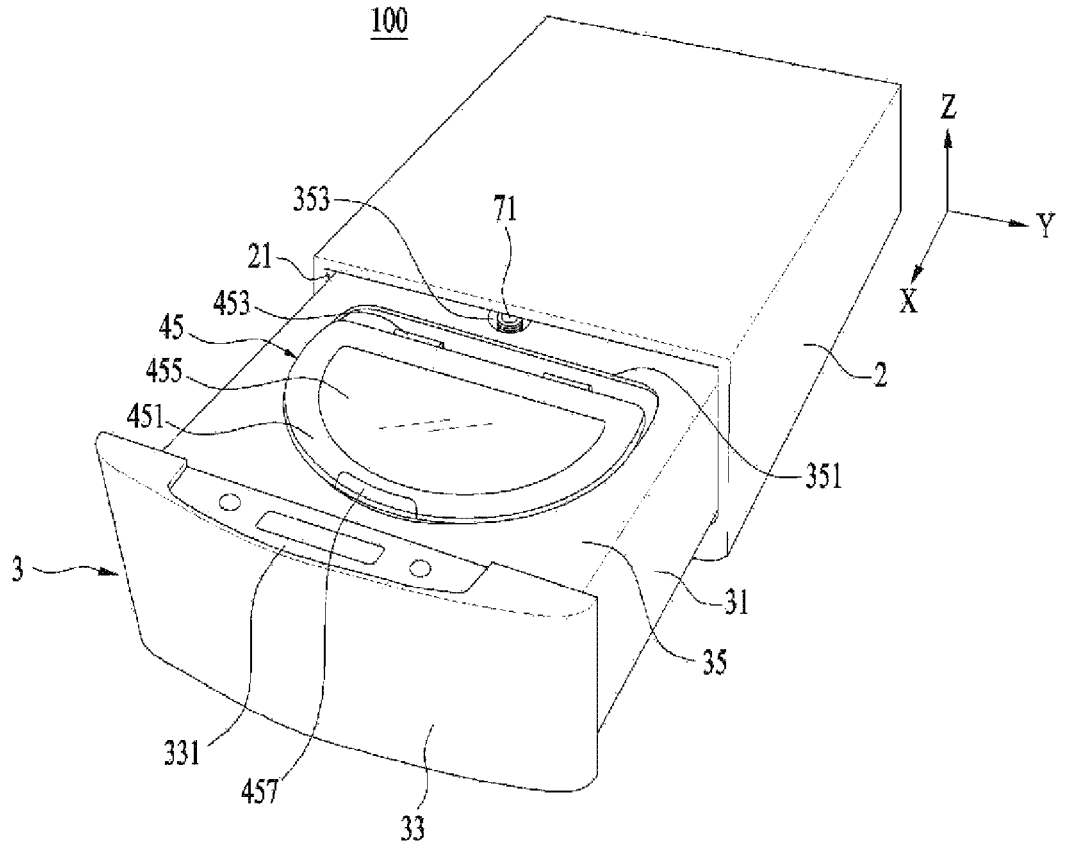

【FIG 2】
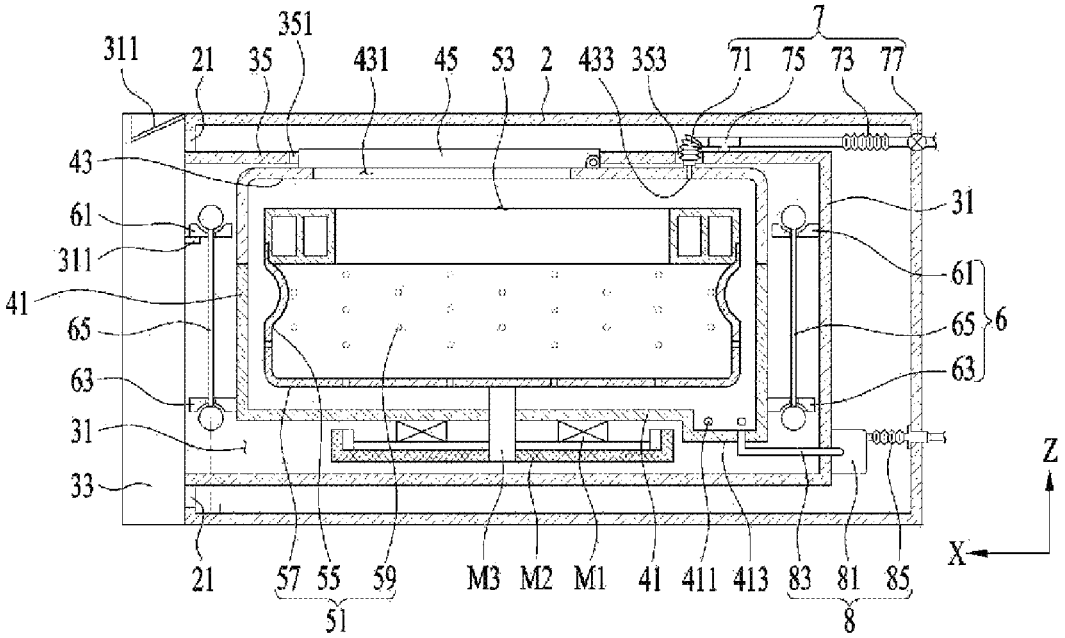

【FIG 3】
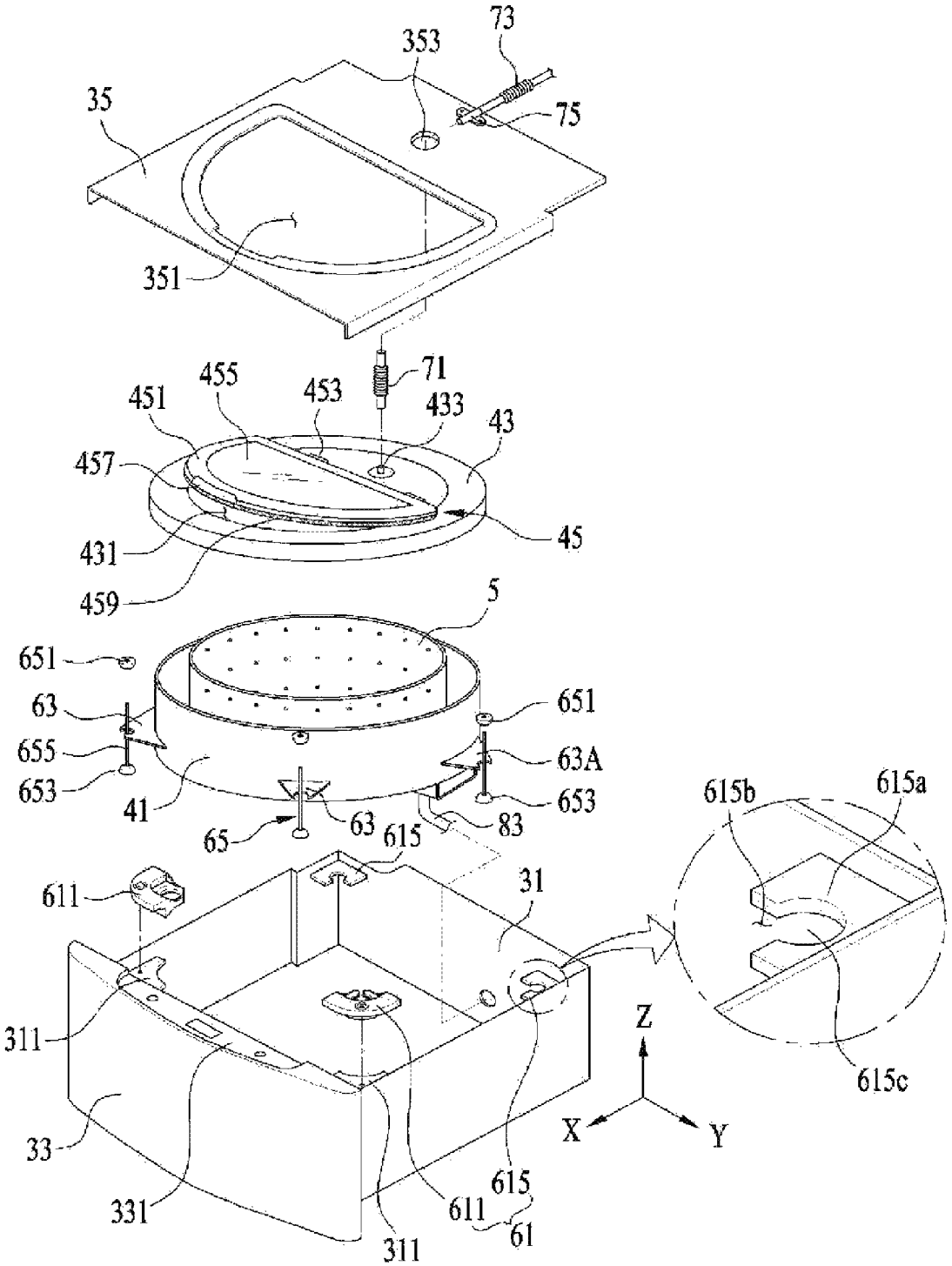

【FIG 4】
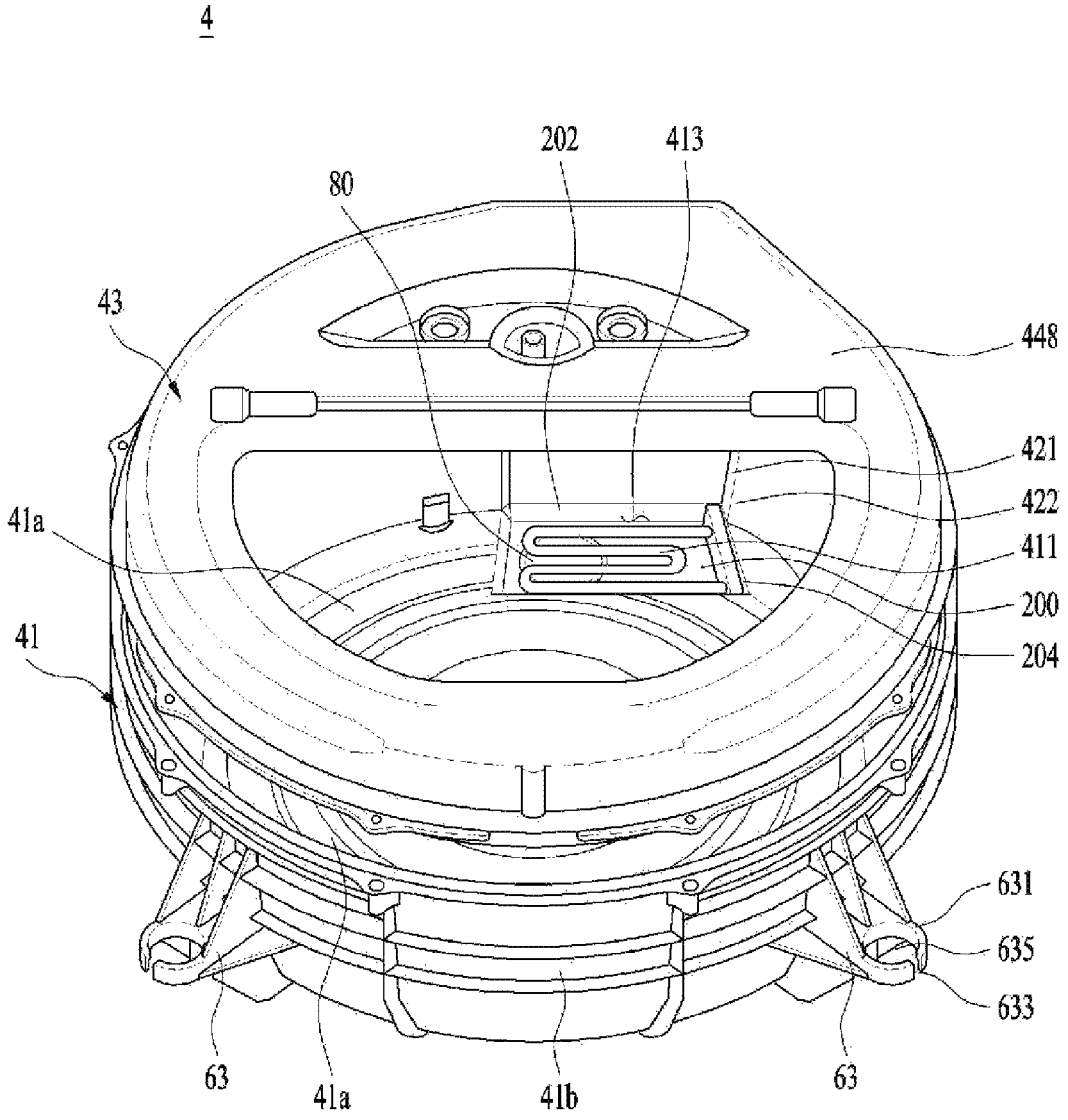

【FIG 5】
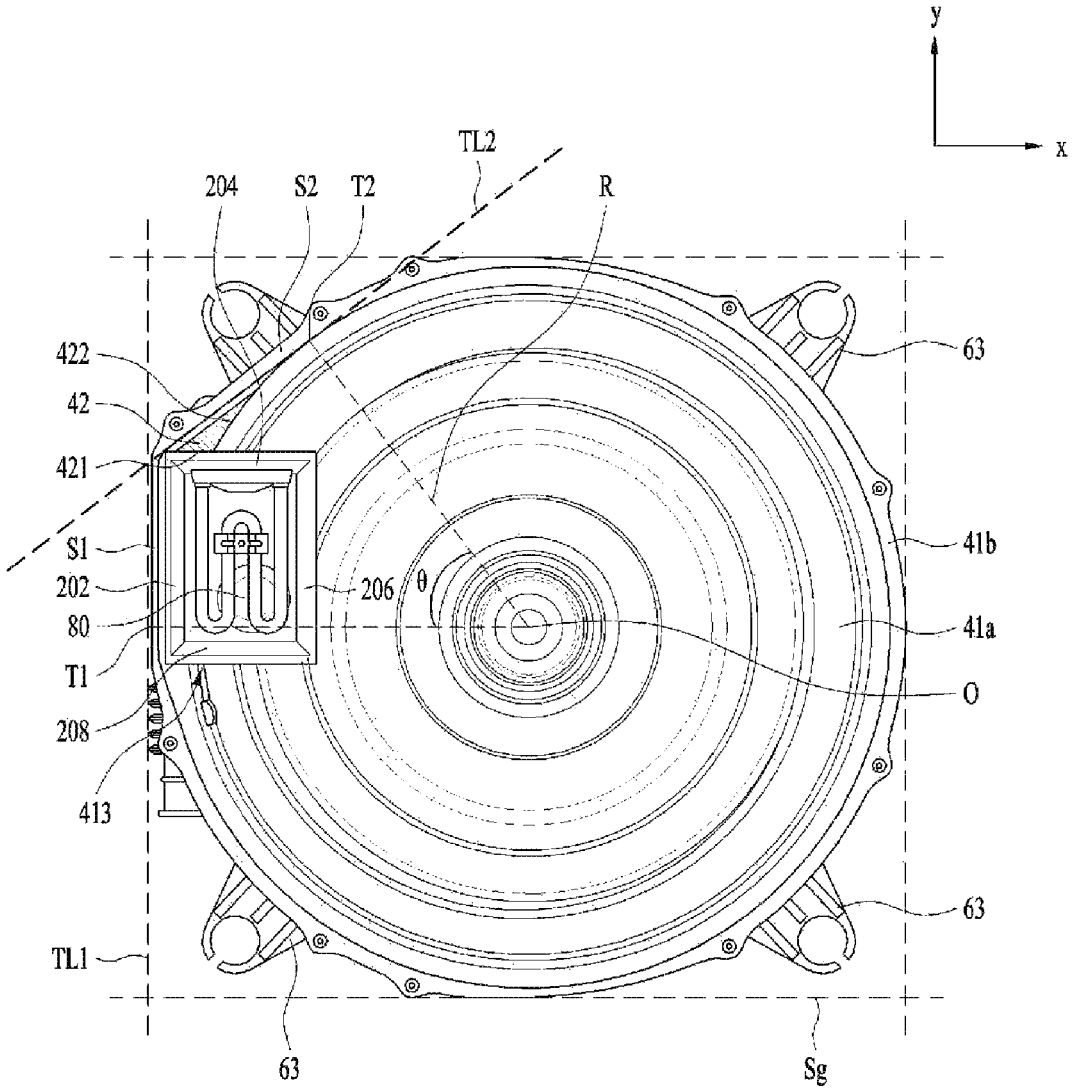

【FIG 6】
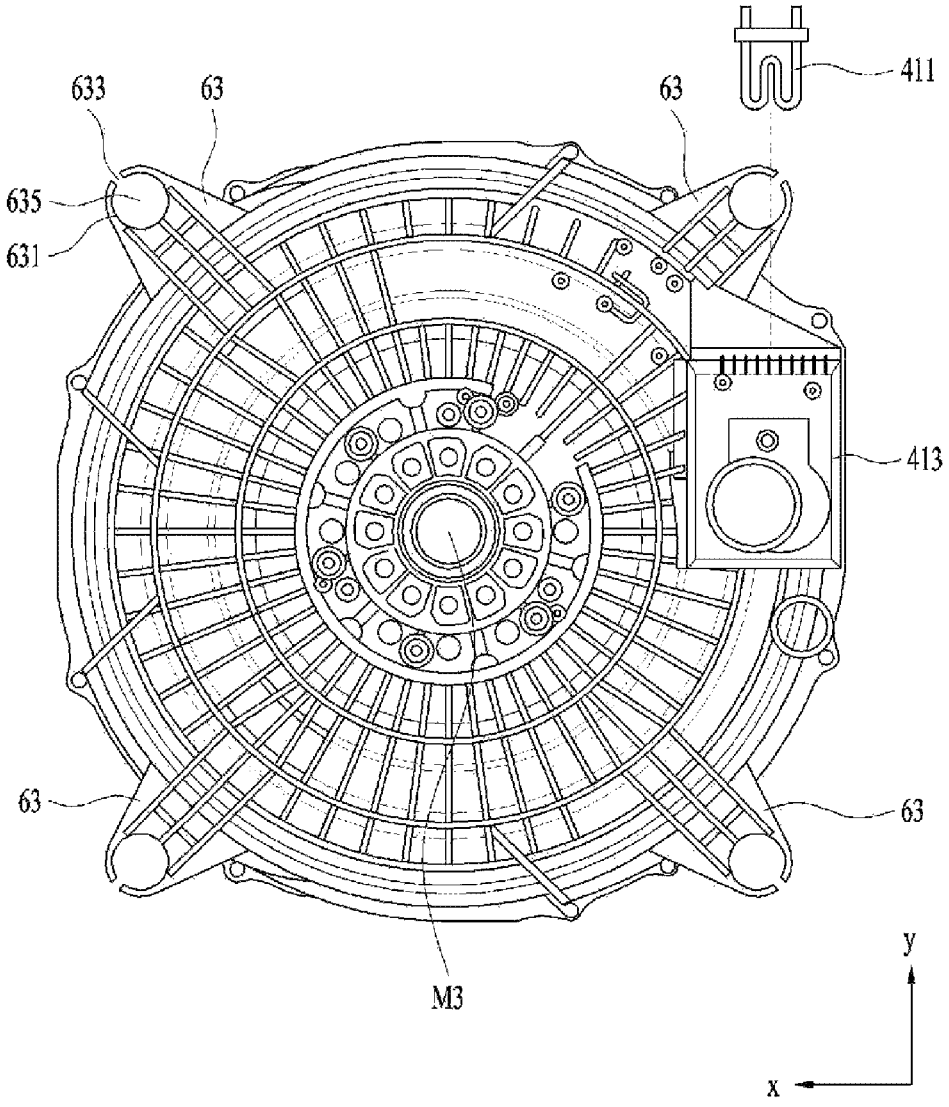

【FIG 7】
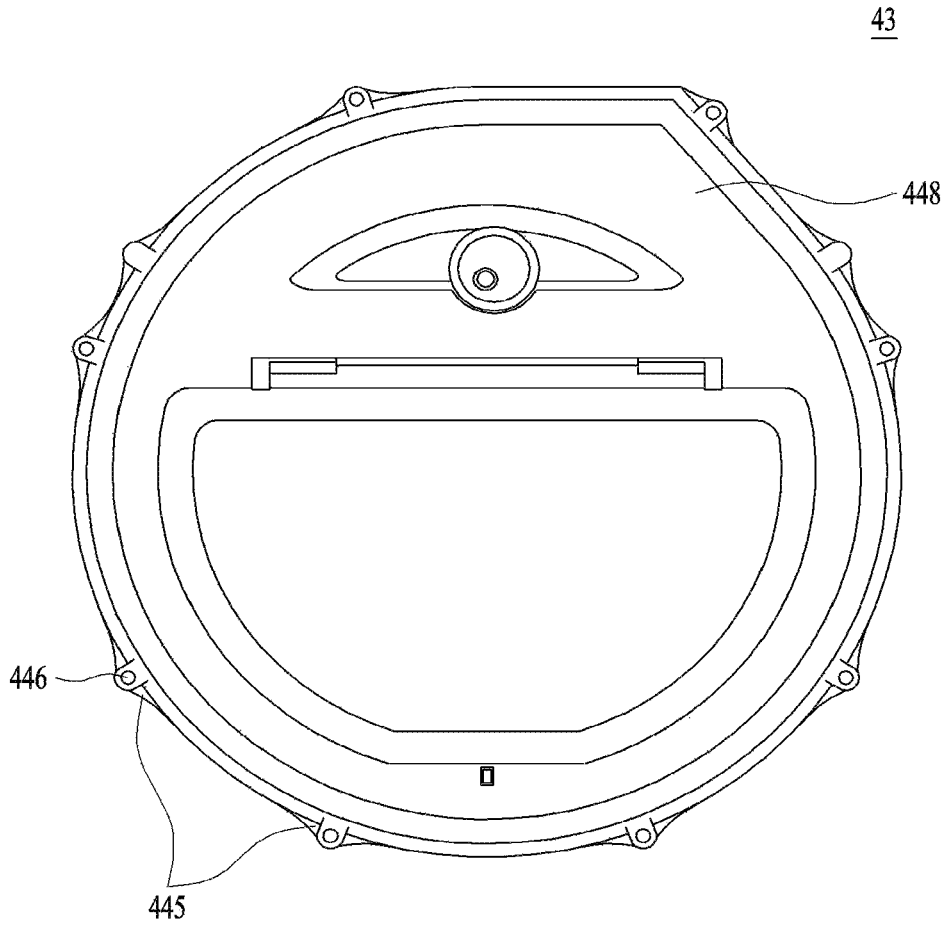
(a)
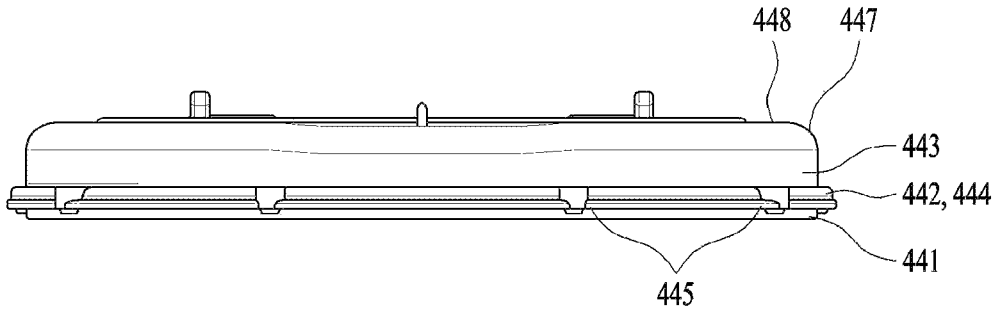
(b)

【FIG 8】
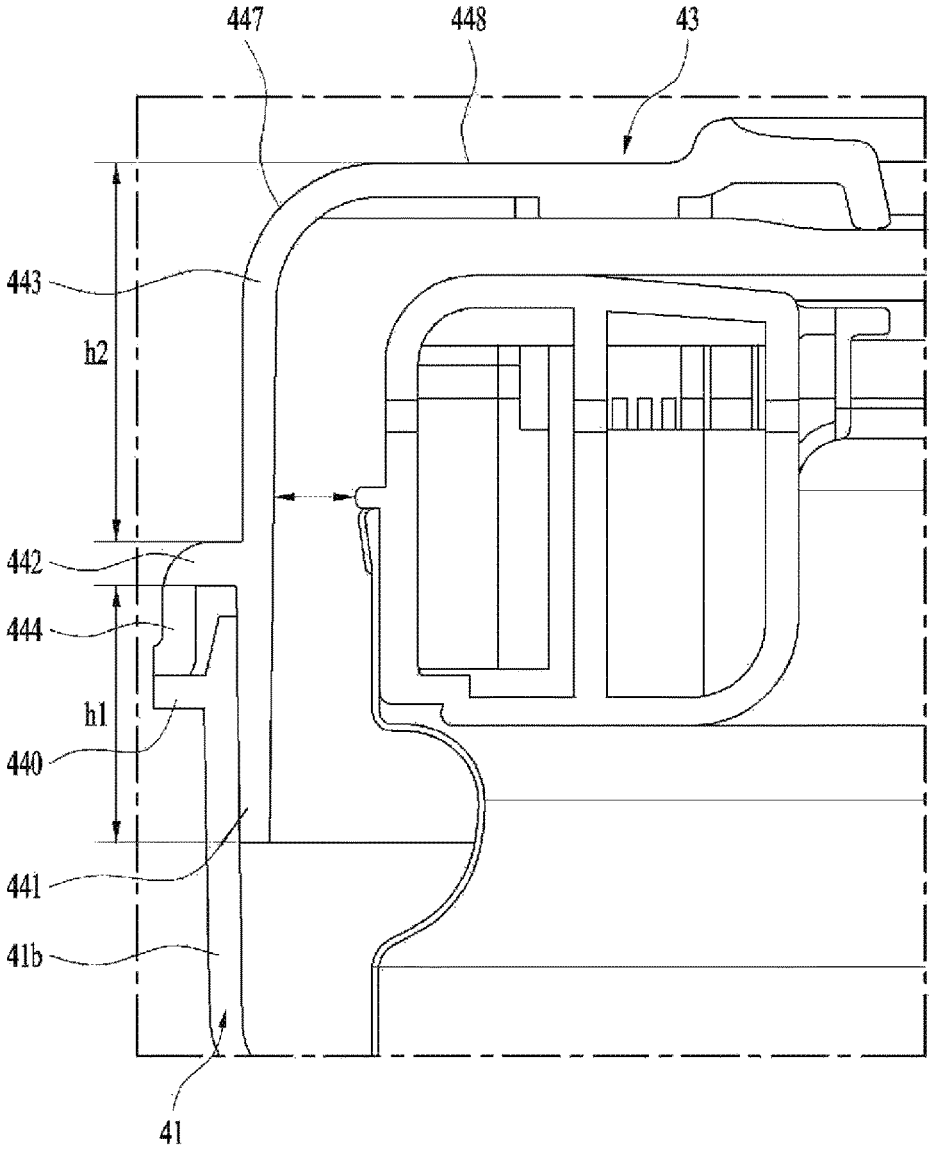

CLOTHES TREATING APPARATUS

CROSS-REFERENCE TO RELATED APPLICATIONS

This application is a National Stage application under 35 U.S.C. § 371 of International Application No. PCT/KR2017/000021, filed on Jan. 2, 2017, which claims the benefit of Korean Application No. 10-2016-0000556, filed on Jan. 4, 2016. The disclosures of the prior applications are incorporated by reference in their entirety.

TECHNICAL FIELD

The present invention relates to a laundry treatment apparatus.

BACKGROUND ART

Generally, laundry treatment apparatuses include an apparatus that washes laundry (an object to be washed or an object to be dried), an apparatus that dries laundry, and an apparatus that is capable of performing both washing and drying of laundry.

Conventional laundry treatment apparatuses are classified into a front-loading-type laundry treatment apparatus, in which laundry is introduced into the laundry treatment apparatus through an introduction hole provided in the front surface thereof, and a top-loading-type laundry treatment apparatus, in which laundry is introduced into the laundry treatment apparatus through an introduction hole provided in the upper surface thereof.

The top-loading-type laundry treatment apparatus includes a cabinet, a tub provided in the cabinet, the tub being provided in the upper surface thereof with an introduction hole, a drum rotatably provided in the tub, and a door configured to open and close the introduction hole.

In the conventional laundry treatment apparatus having the above structure, a heater is provided in the lower surface of the tub. In the case in which the size of the tub is small, however, the heater may interfere with a stator and a rotor.

In addition, in the conventional laundry treatment apparatus, the tub includes a tub body having an open upper surface and a tub cover configured to cover the upper surface of the tub body. However, the rigidity of the conventional tub cover is low, whereby the central part of the tub cover droops.

DISCLOSURE

Technical Problem

One object of the present invention devised to solve the problem lies in a laundry treatment apparatus capable of including a large-capacity heater while minimizing interference between the heater and a driving unit even in the case in which the size of a tub is small.

Another object of the present invention devised to solve the problem lies in a laundry treatment apparatus capable of minimizing a change in the outside size of a tub even in the case in which a large-capacity heater is used with a small-sized tub.

A further object of the present invention devised to solve the problem lies in a laundry treatment apparatus capable of minimizing the disturbance of flow of water stored in a tub even in the case in which a large-capacity heater is used with a small-sized tub.

Technical Solution

The present invention provides a laundry treatment apparatus including a housing, a tub provided in the housing to store water, a drum provided in the tub to store an object to be washed, a driving unit provided at the outer bottom surface of the tub to rotate the drum, a heater configured to heat the water stored in the tub, and an accommodation unit provided in the bottom surface of the tub so as to be recessed downwards, the heater being provided in the accommodation unit, a portion of the accommodation unit protruding from the outer circumference of the bottom surface of the tub in the radial direction.

A first side surface of the accommodation unit may be located so as to be parallel to a tangent to the outer circumference of the bottom surface of the tub.

In addition, one vertex of the accommodation unit may be located at a contact point at which a first tangent and a second tangent to the outer circumference of the tub intersect each other.

Meanwhile, the laundry treatment apparatus may further include a protruding part protruding inwards from a second flat surface of the tub.

One surface of the protruding part may form a second side surface of the accommodation unit.

The tangent to the outer circumference of the bottom surface of the tub may be a first tangent provided at the rear of the tub.

Meanwhile, the tub may include a tub body configured to store the water and a tub cover forming the upper surface of the tub body, and the tub cover may include an insertion part configured to be inserted into the inner circumference of the tub body, a protruding part protruding from the end of the insertion part in the radial direction so as to be supported at the upper side of the tub body, and an extension part extending upwards from the end of the insertion part, the extension part being longer than the insertion part.

The height of the tub body may be lower than the height of the drum.

In addition, the laundry treatment apparatus may further include a bent part bent downwards from the end of the protruding part and a support part protruding from the tub body in the radial direction to support the bent part.

In other words, the first side surface of the accommodation unit may extend from a contact point provided at the outer circumference of the bottom surface of the tub so as to be parallel to the first tangent, which is a tangent to the contact point.

In other words, the first side surface may be provided under a first contact point.

In other words, one vertex of the accommodation unit may be located at a point at which the first tangent and a second tangent to a portion of the outer circumference of the bottom surface of the tub that is rotated from the contact point by a predetermined angle intersect each other.

In other words, the tub may include a protruding part protruding from the outer circumferential surface of the tub to the contact point.

In other words, one surface of the protruding part may form the first side surface of the accommodation unit, and the other surface of the protruding part may form the second side surface of the accommodation unit.

In other words, the second side surface may be perpendicular to the first side surface.

In other words, the first tangent may be provided at the rear of the tub.

Advantageous Effects

The present invention has the effect of providing a laundry treatment apparatus capable of including a large-capacity heater while minimizing interference between the heater and a driving unit even in the case in which the size of a tub is small.

In addition, the present invention has the effect of providing a laundry treatment apparatus capable of minimizing a change in the outside size of a tub even in the case in which a large-capacity heater is used with a small-sized tub.

In addition, the present invention has the effect of providing a laundry treatment apparatus capable of minimizing the disturbance of flow of water stored in a tub even in the case in which a large-capacity heater is used with a small-sized tub.

DESCRIPTION OF DRAWINGS

FIG. 1 is a perspective view showing a laundry treatment apparatus according to an embodiment of the present invention;

FIG. 2 is a sectional view showing the laundry treatment apparatus according to the embodiment of the present invention;

FIG. 3 is an exploded perspective view showing the laundry treatment apparatus according to the embodiment of the present invention;

FIG. 4 is a perspective view showing a tub of the laundry treatment apparatus according to the embodiment of the present invention;

FIG. 5 is a plan view showing a tub body of the laundry treatment apparatus according to the embodiment of the present invention;

FIG. 6 is a bottom view showing the tub body of the laundry treatment apparatus according to the embodiment of the present invention;

FIG. 7 is a view showing a tub cover of the laundry treatment apparatus according to the embodiment of the present invention; and FIG. 8 is a partial sectional view showing the laundry treatment apparatus according to the embodiment of the present invention.

BEST MODE

Reference will now be made in detail to the exemplary embodiments of the present invention, examples of which are shown in the accompanying drawings. Meanwhile, the configuration of an apparatus or a control method thereof, which will be given below, is merely intended to explain exemplary embodiments of the present invention, rather than limiting the technical scope of the present invention. Throughout the specification, the same reference numerals denote the same constituent elements.

A laundry treatment apparatus according to the present invention includes a housing 3, a tub 4 provided in the housing 3 to store water, and a drum 5 rotatably provided in the tub 4 to store laundry.

The housing 3 may be constituted by a cabinet having formed therein a space, in which the tub may be accommodated. Alternatively, as shown in FIG. 1, the housing 3 may be constituted by a drawer, which may be removed from the cabinet 2. In the following description, the housing 3 is constituted by a drawer that is removable from the cabinet 2.

The cabinet 2 may define the external appearance of the laundry treatment apparatus 100, or may simply be a space in which the housing 3 is accommodated. In any case, the cabinet 2 may be provided in the front thereof with an open surface 21, through which the housing 3 is inserted.

The cabinet 2 has a longer length in the width direction (Y-axis direction) than in the height direction (Z-axis direction). In addition, the housing 3 has a longer length in the width direction than in the height direction.

The housing 3 includes a housing body 31 configured to be inserted into the cabinet 2 through the open surface 21, a housing panel 33 fixed to the front surface of the housing body 31 to open and close the open surface 21, and a housing cover 35, which defines the upper surface of the housing body 31.

Since the housing panel 33 is fixed to the front surface of the housing body 31, the housing panel 33 may also serve as a handle used to remove the housing body 31 from the cabinet 2.

The housing panel 33 may be provided with a control panel 331, which allows a user to input a control command related to the operation of the laundry treatment apparatus 100 and displays a message related to the operation of the laundry treatment apparatus.

The housing body 31 may be inserted into the cabinet 2 through the open surface 21. The shape of the housing body 31 is not particularly restricted, as long as the housing body 31 provides a space to accommodate the tub 4. FIG. 1 shows a housing body 31 having a hollow hexahedral shape by way of example.

The housing cover 35 is provided with a first through-hole 351 and a second through-hole 353, through which the inside of the housing body 31 communicates with the outside. The first through-hole 351 is provided for the introduction and removal of laundry while the second through-hole 353 is provided for the supply of water necessary to wash the laundry, which will be described below in detail.

As shown in FIG. 2, the tub includes a tub body 41, which is located in the housing body 31 to store water, and a tub cover 43, which defines the upper surface of the tub body 41.

The tub body 41 may have a cylindrical shape having an open upper surface. An accommodation unit 413 to accommodate a heater 411 is provided in the bottom surface of the tub body 41.

The accommodation unit 413 communicates with the outside via a tub through-part 415. The heater 411 is inserted into the space defined between the bottom surface of the drum and the bottom surface of the tub through the tub through-part 415.

The tub cover 43 may include an introduction hole 431, through which the inside of the tub body 41 communicates with the outside of the tub body, and a supply hole 433, through which water is supplied into the tub body 41.

The introduction hole 431 may communicate with the first through-hole 351 in the housing cover 35, and the supply hole 433 may communicate with the second through-hole 353 in the housing cover. That is, the introduction hole 431 may be located under the first through-hole 351, and the supply hole 433 may be located under the second through-hole 353.

The introduction hole 431 is means that supplies laundry into the tub body 41 or removes the laundry from the tub body. The introduction hole 431 is opened and closed by a door 45.

As shown in FIG. 3, the door 45 may include a frame 451 rotatably coupled to the tub cover 43 via a hinge 453, a window 455 provided at the frame, and a door handle 457 to detachably couple the frame 451 to the tub cover 43. The window 455 may be made of a transparent material such that a user can check the inside of the tub body 41.

The window 455 may be made of a transparent material such that the user can check the inside of the tub body 41 when the housing 3 is removed from the cabinet 2.

Meanwhile, in order to prevent the water in the tub body 41 from being discharged to the outside of the tub body 41 through the introduction hole 431, one of the frame 451 and the tub cover 43 may be further provided with a sealing portion 459 to seal the space between the frame 451 and the introduction hole 431 when the door 45 closes the introduction hole 431.

As shown in FIG. 2, the drum 5, provided in the tub 4, may include a cylindrical drum body 51 having an open upper surface 53. Since the open surface 53 is located under the introduction hole 431, laundry supplied through the introduction hole 431 is supplied into the drum body 51 through the open surface 53.

A plurality of drum through-holes 59, through which the inside of the drum body 51 communicates with the tub body 41, may be provided in the bottom surface 57 and the circumferential surface 55 of the drum body 51.

The drum body 51 is rotated in the tub body 41 by a driving unit. The driving unit may include a stator M1, which is located outside the tub body 41 and is fixed to the bottom surface of the tub body, a rotor M2, which is rotated by a rotating field generated by the stator, and a rotary shaft M3, which extends through the bottom surface of the tub body to interconnect the bottom surface 57 of the drum and the rotor M3. In this case, the rotary shaft M3 may be perpendicular to the bottom surface of the tub body 41.

The tub 4 having the above structure is coupled to the housing body 31 via a tub support unit 6. The tub support unit 6 may include a first support part 61 provided at the housing body 31, a second support part 63 provided at the tub body 41, and a connection part 65 that interconnects the first support part and the second support part.

As shown in FIG. 3, the connection part 65 may include a first connection part 651 located at the first support part 61, a second connection part 653 that supports the second support part 63, and a bar 655 that interconnects the first connection part and the second connection part.

The first connection part 651 may be located in the first support part 61, and may have a shape that is movable in the first support part 61. The second connection part 653 may support the second support part 63, and may have a shape movable in the second support part 63. In an example, the surfaces of the first connection part 651 and the second connection part 653 that contact the respective support parts 61 and 63 may be hemispherical. In another example, the first connection part 651 and the second connection part 653 may be spherical.

Meanwhile, the respective support parts 61 and 63 may be provided at the position at which the bar 655 is perpendicular to the bottom surface of the cabinet 2 (the position at which the bar is perpendicular to the bottom surface of the housing).

The laundry treatment apparatus according to the present invention is configured such that at least three tub support units 6 are provided to couple the tub body 41 to the housing body 31 and such that the bar 655 is perpendicular to the bottom surface of the housing body 31. Consequently, it is possible to increase the distance between the tub cover 43 and the housing cover 35 compared to the case in which the bar 655 is inclined at a predetermined angle relative to the Z-axis. Even when the tub body 41 vibrates in the housing body 31, therefore, the tub support units 6 may reduce the possibility of the tub cover 43 colliding with the housing cover 35.

As shown in FIG. 4, the second support part 63, provided at the tub body 41, may include an accommodation recess 631, in which the second connection part 653 is located, a through-hole 635, into which the bar 655 of the connection part is inserted, and a slit 633, through which the bar 655 is inserted into the center of the through-hole from the edge of the through-hole.

The first support part 61 and the second support part 63 may serve as support points of the connection part 65 when the tub body 41 is vibrated. For this reason, it is advantageous for the frictional force between the first support part 61 and the first connection part 651 and the frictional force between the second support part 63 and the second connection part 653 to be small. Consequently, the first support part 61 and the second support part 63 may be made of a self-lubricative material.

When considering that it is natural for the first support part 61 to be made of the same material as the housing body 31 by injection molding and for the second support part 63 to be made of the same material as the tub body 41 by injection molding, however, only the first connection part 651 and the second connection part 653 may be made of a self-lubricative material, or only a first bracket 611, the first connection part 651, and the second connection part 653 may be made of a self-lubricative material.

In order to most stably support the tub body 41, a plurality of second support parts 63 may be radially disposed at the circumferential surface of the tub body 41 so as to be spaced apart from each other by the same angle. That the second support parts 63 are radially disposed at the circumferential surface of the tub body means that the second support parts 63 are provided so as to be symmetrical with respect to the rotary shaft M3, which is located at the center of the bottom surface of the tub body.

In the laundry treatment apparatus 100 having the above structure, water is supplied to the tub 4 through the water supply unit 7, and the water stored in the tub 4 is discharged to the outside of the cabinet 2 through the drainage unit 8.

As shown in FIG. 2, the water supply unit 7 may include a first water supply pipe 71 connected to the supply hole 433 provided in the tub cover, a second water supply pipe 73 connected to a water source located outside the cabinet, and a connection pipe 75 fixed to the tub cover 43 to interconnect the first water supply pipe and the second water supply pipe.

The first water supply pipe 71 may interconnect the supply hole 433 and the connection pipe 75 through the second through-hole 353 provided in the housing cover 35, and may be constituted by a bellows pipe in order to prevent the first water supply pipe 71 from being separated from the connection pipe 75 when the tub 4 is vibrated (see FIG. 3).

In addition, the second water supply pipe 73 may also be constituted by a bellows pipe in order to prevent the second water supply pipe 73 from being separated from the connection pipe 75 when the housing is removed from the cabinet 2. The second water supply pipe 73 is opened and closed by a water supply valve 77, which is controlled by a controller (not shown).

Unlike what is shown in FIG. 2, however, the water supply unit 7 may include a single water supply pipe that interconnects a water source (not shown) located outside the cabinet and the supply hole 433 provided in the tub cover. In this case, the water supply pipe may be constituted by a bellows pipe.

The drainage unit 8 may include a drainage pump 81 fixed to the housing body 31, a first drainage pipe 83 configured to guide the water in the tub body 41 to the drainage pump 81, and a second drainage pipe 85 configured to guide the water discharged from the drainage pump 81 to the outside of the cabinet 2. In this case, the second drainage pipe 85 may be constituted by a bellows pipe.

FIG. 4 is a perspective view showing the tub of the laundry treatment apparatus according to the embodiment of the present invention. FIG. 5 is a plan view showing the tub body of the laundry treatment apparatus according to the embodiment of the present invention. FIG. 6 is a bottom view showing the tub body of the laundry treatment apparatus according to the embodiment of the present invention.

The accommodation unit for accommodating the tub body 41 and the heater 411 will be described below in detail.

As shown in FIG. 4, the tub 4 includes a tub body 41, which is located in the housing body 31 to store water, and a tub cover 43, which defines the upper surface of the tub body 41.

The upper surface of the tub body 41 is open. The tub body 41 includes a bottom surface 41*a* of the tub body 41 and a side surface 41*b* of the tub body 41.

An accommodation unit 413 to accommodate a heater 411 is provided in the bottom surface 41*a* of the tub body 41.

The heater 41 heats the water stored in the tub 4 to provide hot water necessary for washing, or changes the water into steam, which is supplied to laundry. A sheath heater is generally used as the heater 41. The sheath heater, which is a basic electric heater, is a pipe-shaped heater configured such that an electric wire is mounted in a metal protection pipe in the form of a coil and the metal protection pipe is filled with magnesium oxide, which is insulative powder, in order to insulate the electric wire and the protection pipe.

The accommodation unit 413 is provided in the bottom surface 41*a* of the tub body 41 so as to be recessed downwards. The heater, which is accommodated in the accommodation unit 413, does not protrude above the bottom surface 41*a* of the tub body 41. That is, the heater 411 is located between the bottom surface 57 of the drum and the bottom surface 41*a* of the tub. The heater 411 is accommodated in the accommodation unit 413 so as not to protrude from the bottom surface 41*a* such that the heater 411 does not collide with the drum 5 when the drum is rotated by the driving unit.

At the outside of the tub 4, the accommodation unit 413 is provided so as to protrude downwards from the bottom surface 41*a* of the tub. In this case, one side of the accommodation unit communicates with the outside through a tub through-part 415. The heater 411 may be inserted into or removed from the accommodation unit 413 through the tub through-part 415. The heater 411 is inserted into the accommodation unit 413, and is then installed in the accommodation unit 413.

In consideration of the fact that the accommodation unit 413 is means that initially supplies water into the tub body 41 to the heater 411 in order to prevent overheating of the heater and prevents the heater from being damaged by the bottom surface 57 of the drum during the rotation of the drum 5, it is inevitable for the accommodation unit 413 to protrude from the bottom surface of the tub body 41.

As previously described, in order to rotate the drum 5, the driving unit includes the stator M1, which is installed outside the tub body 41 and fixed to the bottom surface 41*a* of the tub body 41, and the rotor M2, which is rotated by the stator.

Consequently, it is necessary to prevent the rotating rotor M2 from being interfered with by the accommodation unit 413. However, the size of the driving unit, which rotates a drum 5 having a predetermined size or more, is fixed, irrespective of the size of the drum 5.

In the case in which the size of the tub 4 is large and thus the diameter of the tub 4 is large, the accommodation unit 413, which protrudes from the bottom surface 41*a* of the tub 4, is provided inside the outer circumference of the bottom surface 41*a* of the tub 4 with a spatial margin. Even though the stator M1 and the rotor M2 are installed, therefore, the rotor M2 and the accommodation unit 413 do not interfere with each other.

In the case in which the size of the tub 4 is reduced, the diameter of the tub 4 is reduced, but the size of the stator M1 and the rotor M2 is not reduced. As a result, it is not possible to provide the accommodation unit 413 in the outer circumference of the bottom surface 41*a* of the tub 4.

In addition, the height of the accommodation unit 413, by which the accommodation unit 413 can protrude from the bottom surface of the tub body, is limited (the thickness of the heater is limited). In the case in which the length or the width of the accommodation unit 413 is reduced, it is necessary to reduce the size of the heater 411. In this case, it is difficult to mount a heater capable of generating a large amount of heat per unit time.

In order to solve the above problem, the laundry treatment apparatus according to the present invention is configured to have a structure in which the accommodation unit 413 is provided in the outer circumference of the bottom surface 41*a* of the tub 4 such that a portion of the accommodation unit 413 protrudes in the radial direction.

A portion of the area of the accommodation unit 413 protrudes from the outer circumference of the bottom surface 41*a* of the tub 4. That is, a portion of the area of the accommodation unit 413 deviates from the radius R of the bottom surface 41*a* of the tub 4.

Consequently, the rotor M is rotated without being interfered with by the accommodation unit 413.

If the accommodation unit 413 deviates from the bottom surface 41*a* of the tub 4, however, the size of the tub 4 is increased, whereby interference with the housing 3 occurs. In order to solve the above problem, it is necessary to minimize the size of the accommodation unit 413 that deviates and protrudes from the bottom surface 41*a* of the tub 4.

As shown in FIGS. 5 and 6, the accommodation unit 413 is provided at the rear side of the bottom surface 41*a* of the tub 4 (in the negative x-axis direction). Consequently, the front side of the tub 4, which is exposed to the user, may remain curved. In addition, the accommodation unit 413 includes a drainage hole 80 formed in a bottom surface 200 thereof. The drainage hole 80 is connected to the first drainage pipe 83, and the first drainage pipe 83 is connected to the drainage pump 81, which is provided at the rear surface of the housing body 31.

Consequently, it is possible to minimize the length of the first drainage pipe 83.

The accommodation unit 413 is quadrangular, and is provided in the bottom surface 41*a* of the tub 4 so as to be recessed. The accommodation unit 413 may have a bottom surface 200, a first side surface 202, a second side surface 204, a third side surface 206, and a fourth side surface 208.

The first side surface 202 of the accommodation unit 413 may be parallel to a tangent to the outer circumference of the bottom surface 41*a* of the tub.

Specifically, the first side surface 202 may be provided so as to be parallel to a first tangent TL1 to the outer circumference of the bottom surface 41*a* of the tub 4. Alternatively, the first side surface 202 may be provided so as to be the same as the first tangent TL1 to the outer circumference of the bottom surface 41*a* of the tub 4.

The first tangent TL1 is a tangent of a point T1 located at the rear side of the bottom surface 41*a* of the tub 4 from the center O thereof (in the negative x-axis direction). That is, the first side surface 202 is provided so as to be parallel to the rear surface of the housing body 31.

In other words, the first side surface 202 may have a contact point T1, which contacts the outer circumference of the bottom surface 41*a* of the tub 4, and may extend parallel to the first tangent TL1, which is formed at the contact point T1.

Specifically, the first side surface 202 may be provided under the contact point T1, since the accommodation unit 413 is provided in the bottom surface of the tub 4.

The first side surface 202 may extend from the contact point T1 so as to be parallel to the first tangent TL1 only in one direction, or may extend from the contact point T1 so as to be parallel to the first tangent TL1 in both directions (opposite directions).

That is, the first side surface 202 may include a contact point that forms the outer circumference of the bottom surface 41*a* of the tub 4 and an extension surface that extends from the contact point.

The second side surface 204 of the accommodation unit 413 is connected to the first side surface 202 in order to form the accommodation unit 413. The second side surface 204 may be perpendicular to the first side surface 202. The tub through-part 415 is formed in the second side surface 204. The heater is inserted into the accommodation unit 413 through the tub through-part 415, and is then installed in the accommodation unit 413.

The second side surface 204 of the accommodation unit 413 protrudes from the outer circumference of the bottom surface 41*a* of the tub 4. That is, one end of the second side surface 204 of the accommodation unit 413 deviates from the radius R of the outer circumference of the bottom surface 41*a* of the tub 4.

Meanwhile, the third side surface 206 of the accommodation unit 413 is connected to the second side surface 204 so as to be parallel to the first side surface 202, and the fourth side surface 208 of the accommodation unit 413 is connected to the first side surface 202 and the third side surface 206 so as to be parallel to the second side surface 204.

When defining a tangent at a point T2 located at the outer circumference of the bottom surface 41*a* of the tub 4, which is rotated by a predetermined angle θ from the point T1 located at the outer circumference of the bottom surface 41*a* of the tub 4 on the basis of the center of the bottom surface of the tub 4, as a second tangent TL2, one vertex of the accommodation unit 413 may be located at a contact point C at which the first tangent TL1 and the second tangent TL2 intersect each other.

The contact point C may be defined as a point C in order to avoid confusion of terms.

Meanwhile, the accommodation unit 413 may protrude from the bottom surface 41*a* of the tub in the circumferential direction of the tub, and the side surface 41*b* of the tub 4 may have a cylindrical shape. In the present invention, however, the outer circumferential surface of the side surface 41*b* of the tub body 41 may have a first flat surface S1 between the point T1 and the point C, a second flat surface S2 between the point C and the point T2, and a curved surface between the point T1 and the point T2 in order to make it easy to form the tub body 41. In this case, the first flat surface S1 may be parallel to the first side surface 202. Consequently, the side surface 41*b* of the tub is perpendicular to the bottom surface 41*a* of the tub including the accommodation unit 413, whereby it is possible to easily form the tub body 41.

Therefore, it is possible to minimize the range of the accommodation unit 413 within which the accommodation unit 413 deviates from the outer circumference of the tub 4. The reason for this is that, on the assumption that an imaginary quadrangular area of the tub body 41 in the housing 3 is Sq, it is necessary to increase the size of the housing 3 in order to maintain the distance between the tub 4 and the housing 3 when the area of the quadrangle Sq is increased. However, the accommodation unit 413, provided in the bottom surface 41*a* of the tub 4, is provided so as not to substantially increase the area of the quadrangle Sq. The reason for this is that the accommodation unit 413 is provided in the space of the quadrangle Sq that is not occupied by the tub 4, whereby the external volume of the tub 3 is increased.

That is, it is not necessary to reduce the size of the tub body 41 due to interference with the housing 3, even though the volume of the tub body 41 is increased.

Meanwhile, it is necessary to minimize interference with the accommodation unit 413 when the water stored in the tub body 41 is rotated along with the rotation of the drum 5.

To this end, the laundry treatment apparatus according to the present invention includes a protruding part 42 protruding from the inner circumferential surface of the tub body 41.

The protruding part 42 is provided so as to protrude inwards from the second flat surface S2, which constitutes the tub body 41. Alternatively, the protruding part 42 may be provided so as to protrude inwards from the second tangent TL2.

The protruding part 42 includes a first protruding surface 421 provided so as to be parallel to the second side surface 204 of the accommodation unit and a second protruding surface 422 configured such that the distance between the second protruding surface 422 and the center O of the tub 4 is the radius R of the bottom surface 41*a* of the tub body 41.

Since the first protruding surface 421 is vertically provided so as to be parallel to the second side surface 204, it is possible to easily form the tub body 41 including the accommodation unit 413.

The inner circumferential surface of the side surface 41*b* of the tub body 41, excluding the portion thereof in which the accommodation unit 413 is provided, remains circular due to the second protruding surface 422. When the water stored in the tub 4 is rotated as the result of rotating the drum 5, therefore, the water may smoothly move in the tub 4 along the second protruding surface 422, whereby it is possible to minimize eddy current generated in the accommodation unit 413.

FIG. 7 is a view showing the tub cover of the laundry treatment apparatus according to the embodiment of the present invention. FIG. 8 is a partial sectional view showing the laundry treatment apparatus according to the embodiment of the present invention.

The tub body and the tub cover of the present invention will be described with reference to FIGS. 7 and 8.

The height of the tub body 41 is configured to be smaller than the height of the drum 5, but the height of the tub cover 43 is increased such that the tub body 41 and the tub cover 43 are coupled in order to provide the drum 5 in the tub 4. It is not easy to install the drum 5 in the tub 4, since the space between the tub and the drum is not wide. Since the tub body is not high, however, it is possible for a worker to install the drum in the tub body while holding the upper side of the drum, whereby it is possible for the worker to easily perform the assembly process.

The tub cover 43 may include an insertion part 441, which is inserted into the inner circumference of the tub body 41, a protruding part 442, which protrudes from the end of the insertion part 441 in the radial direction so as to be supported at the upper side of the tub body 41, and an extension part 443, which extends upwards from the end of the insertion part 441.

The outer circumferential diameter of the insertion part 441 is configured to be smaller than the inner circumferential diameter of the side surface 41*b* of the tub body 41 such that the insertion part 411 can be inserted into the tub body 41.

The protruding part 442 extends from the side surface of the tub cover 43 in the radial direction. The protruding part 442 is provided around the tub cover 43 to support the tub cover at the upper side of the tub body.

The extension part 443 extends upwards from the end of the insertion part 441 or the protruding part 442, and an upper surface 448 of the tub is provided at the end of the extension part. Compared to the case in which the horizontal upper surface of the tub is provided at the protruding part 442 without the extension part 443, therefore, it is possible to increase the rigidity of the tub cover, whereby it is possible to prevent twisting or drooping of the tub cover.

In this case, the height h2 of the extension part 443 is configured to be larger than the length h1 of the insertion part 441. Consequently, it is possible to substantially increase the inner volume of the tub 4. In addition, it is possible to increase the rigidity of the tub cover, whereby it is possible to prevent drooping of the central part of the tub cover.

Meanwhile, the tub cover 43 may include a curved part 447 provided between the end of the extension part 443 and the upper surface 448 of the tub 4 so as to be bent toward the inside of the tub. Consequently, the area of the upper surface 448 of the tub may be reduced, by which the load applied to the center of the upper surface may be reduced, whereby it is possible to prevent drooping of the upper surface of the tub and to prevent twisting of the tub cover.

In other words, the extension part 443, provided at the upper side of the protruding part 442 of the tub cover 43, the curved part 447, and the upper surface 448 of the tub form the shape of a cup, whereby the rigidity of the tub cover is increased.

Meanwhile, the tub cover 43 includes a bent part 444 bent downwards from the end of the protruding part 442. The bent part 444 is provided around the tub cover 43. Consequently, the rigidity of the tub cover 43 is increased, whereby it is possible to prevent twisting or drooping of the tub cover.

In addition, a support part 440 protruding from the tub body 41 in the radial direction may be provided in order to support the bent part 444. Consequently, the end of the bent part 444 is supported at the upper surface of the support part 440.

The tub cover 43 includes a reinforcement rib 445 protruding in the radial direction of the protruding part 442. The reinforcement rib 445 is provided with a first fastening hole 446 provided to fasten the tub cover 43 to the tub body 41. A second fastening hole (not shown) may be provided in the support part 440 of the tub body 41. When the upper side of the tub body 41 is covered by the tub cover 43, the second fastening hole may communicate with the first fastening hole 446. Consequently, it is possible to fix the tub body and the tub cover using a fixing member extending through the first fastening hole 446 and the second fastening hole (not shown).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:

a housing;

a tub located in the housing and configured to receive water, wherein a width of the tub is greater than a height of the tub;

a drum located in the tub and configured to receive laundry;

a driving unit located at an outside of a bottom surface of the tub and configured to rotate the drum;

a heater configured to heat water received in the tub; and an accommodation unit that is located at the bottom surface of the tub, that defines a recess at the bottom surface of the tub, and that is configured to receive the heater in the recess, wherein the accommodation unit includes a protruded portion that protrudes from an outer circumference of the tub toward a rear surface of the housing and that is disposed on or inward of a rear side of the tub that faces the rear surface of the housing.

2. The laundry treatment apparatus according to claim 1, wherein the accommodation unit includes a first side surface that extends from a first point at the outer circumference of the bottom surface of the tub in a first tangential direction of the outer circumference of the bottom surface.

3. The laundry treatment apparatus according to claim 2, wherein the accommodation unit further includes a corner that is located at an intersection between a first tangential plane that extends from the first point in the first tangential direction and a second tangential plane that extends from a second point of the outer circumference of the bottom surface in a second tangential direction that intersects the first tangential direction.

4. The laundry treatment apparatus according to claim 3, wherein the first point and the second point of the outer circumference of the bottom surface are spaced apart from each other by a predetermined angle with respect to a center of the bottom surface of the tub.

5. The laundry treatment apparatus according to claim 4, wherein the tub comprises a protruding part that protrudes from an outer circumferential surface of the tub to the intersection between the first and second tangential planes.

6. The laundry treatment apparatus according to claim 5, wherein the protruding part has a first surface that defines the first side surface of the accommodation unit, and a second surface that defines a second side surface of the accommodation unit.

7. The laundry treatment apparatus according to claim 6, wherein the second side surface of the accommodation unit is perpendicular to the first side surface of the accommodation unit.

8. The laundry treatment apparatus according to claim 2, wherein the first point is located at a rear of the tub, and the first side surface of the accommodation unit is located at the rear of the tub.

9. The laundry treatment apparatus according to claim 1, wherein the tub comprises:

a tub body configured to store the water; and a tub cover located vertically above an upper surface of the tub body, and wherein the tub cover comprises:

an insertion part configured to insert into an inner circumference of the tub body, a protruding part that protrudes from an end of the insertion part in a radial direction and that is configured to be supported by an upper side of the tub body, and an extension part that extends upward from the end of the insertion part, wherein a length of the extension part from the end of the insertion part is greater than a length of the insertion part.

10. The laundry treatment apparatus according to claim 9, wherein a height of the tub body is less than a height of the drum with respect to the bottom surface of the tub.

11. The laundry treatment apparatus according to claim 9, further comprising:

a bent part that extends downward from an end of the protruding part; and a support part that protrudes from the tub body in the radial direction and that is configured to support the bent part.

12. The laundry treatment apparatus according to claim 9, wherein the upper surface of the tub body defines an opening that is configured to receive water and laundry and that is located vertically below an uppermost surface of the drum.

13. The laundry treatment apparatus according to claim 9, wherein the tub cover defines an introduction hole that allows introduction of laundry to the drum and a supply hole that allows supply of water to the tub body.

14. The laundry treatment apparatus according to claim 11, wherein the support part is configured to contact the bent part based on insertion of the insertion part into the inner circumference of the tub body.

15. The laundry treatment apparatus according to claim 1, wherein the accommodation unit has a quadrangular shape that protrudes from the outer circumference of the bottom surface in a radial direction.

16. The laundry treatment apparatus according to claim 1, wherein a distance from a front portion of the tub to a rear end of the protruded portion is greater than a diameter of the bottom surface of the tub.

17. The laundry treatment apparatus according to claim 1, wherein the accommodation unit is located on the rear side of the tub.

18. A laundry treatment apparatus comprising:

a housing;

a tub located in the housing and configured to receive water, wherein a width of the tub is greater than a height of the tub;

a drum located in the tub and configured to receive laundry;

a driving unit located vertically below a bottom surface of the tub and configured to rotate the drum;

a heater configured to heat water received in the tub; and an accommodation unit that is located at the bottom surface of the tub, that defines a recess at the bottom surface of the tub, and that is configured to receive the heater in the recess, wherein the accommodation unit includes a first portion that is located outside of an outer circumference of the bottom surface of the tub, and a second portion that is located inside of the outer circumference of the bottom surface of the tub, wherein an area of the first portion is less than an area of the second portion, and wherein the first portion is a protruded portion that protrudes from the outer circumference of the bottom surface of the tub toward a rear surface of the housing in a radial direction and that is disposed on or inward of a rear side of the tub that faces the rear surface of the housing.

19. The laundry treatment apparatus according to claim 18, wherein the tub defines at least a part of the first portion of the accommodation unit.

20. The laundry treatment apparatus according to claim 18, wherein the first portion of the accommodation unit includes a first side surface that extends from a first point at the outer circumference of the bottom surface of the tub in a first tangential direction of the outer circumference of the bottom surface.

21. The laundry treatment apparatus according to claim 20, wherein the first portion of the accommodation unit further includes a corner that is located at an intersection between a first tangential plane that extends from the first point in the first tangential direction and a second tangential plane that extends from a second point of the outer circumference of the bottom surface in a second tangential direction that intersects the first tangential direction.

22. The laundry treatment apparatus according to claim 21, wherein the tub comprises a protruding part that protrudes from an outer circumferential surface of the tub to the intersection between the first and second tangential planes.

* * * * *